US005590794A

United States Patent [19]

Zachary

[11] Patent Number: 5,590,794

[45] Date of Patent: Jan. 7, 1997

[54] SORTING MODULE INSTALLATION

[76] Inventor: Gordon E. Zachary, 61 E. Main St., Hagerstown, Ind. 47346

[21] Appl. No.: 415,482

[22] Filed: Apr. 3, 1995

[51] Int. Cl.[6] ..... B07C 7/02

[52] U.S. Cl. ..... 209/702; 211/10

[58] Field of Search ..... 209/702, 703, 209/704; 211/10, 184; 232/24, 25, 26; 312/198; 206/561; 220/531

[56] References Cited

U.S. PATENT DOCUMENTS

| | | | |
|---|---|---|---|
| 1,030,317 | 6/1912 | Middaugh | 211/10 |
| 1,217,973 | 3/1917 | Mann | 211/10 X |
| 1,593,326 | 7/1926 | Bourn | 211/10 X |
| 2,251,408 | 8/1941 | Johnson | 211/10 X |
| 3,905,484 | 9/1975 | Dean et al. | 211/10 X |

*Primary Examiner*—F. J. Bartuska
*Attorney, Agent, or Firm*—Robert A. Spray

[57] ABSTRACT

Apparatus and procedure for sorting mail and the like rapidly and accurately. An array of sorting modules each contain a shelf or base and a series of vertical separator panels which divide the shelf area into a plurality of bins into which individual mail items may be selectively placed. A frontal connection feature extends transversely of the shelf, holding all of the grid of panels for movability as a set upwardly away from the shelf, but also individually movable transversely to give a bin-size adjustment to individual bins automatically in accordance with respective bins' needs. The frontal connection provides for the upward rotation with respect to the shelf, from a fore-and-aft panel-position which provides the sorting bins to move to an upraised position in which the panels are freed from the sorted mail batches so that the full set of sorted mail batches may be bundled as a group of code sets. An array of such shelf-and-panel modules are releasably retained on a large rack, by which the individual modules may be positioned and removed. The various features provide a sorting station installation particularly beneficial to that of a U.S. Post Office facility, although the concepts are not limited to that type of use.

12 Claims, 8 Drawing Sheets

SORTING MODULE INSTALLATION

FIELD AND BACKGROUND OF THIS INVENTION

This invention relates to apparatus and procedure for the sorting of mail envelopes or the like, and more particularly relates to apparatus and procedure for achieving a division of a multiplicity of such mail or mail-like objects into a sequence of bundled sets.

Still more particularly, the present invention relates to apparatus and procedure by which the bundled sets may be handled, as a group of sets, for the placing of usefully-divided groups of the objects on or onto subsequent delivery or transfer apparatus.

Since a particular and especially desirable use of the present invention relates to the sorting of mail, of which the individual items of envelopes or cards are substantially self-supporting when resting on an edge thereof, the invention and its concepts are herein described as in the task of sorting mail, with the divisions of the assortment of mail being those of whatever area or route code or group-designation is in use for the particular mailing situation.

PROBLEMS INHERENT AS TO THE TASK OF SORTING MAIL OR THE LIKE

The task of sorting of mail has long been realized to include particular factors of difficulty, all of which are minimized by the use of the present invention's apparatus and procedure. Such problems include the following:

a. Minimization of labor costs, especially considering the high-volume nature often occurring;

b. Minimization of tiresomeness of the attendant, especially considering the high-volume nature occurring;

c. Minimization of errors in the sorting procedure, especially considering the high-volume nature often occurring;

d. Minimization of time involved, especially considering the high-volume nature occurring;

e. Maximum production need per man-hour expended;

f. Irregularity and non-uniformity of the amount of items per individual groups;

g. Irregularity of object-sizes;

h. Minimization of work area requirements; and i. Changeability of facilities to be allotted to individual designations.

In summary as to the problems of high-volume mail sorting, the factors of output and accuracy, in addition to the burden of labor costs and space allotment, have long been realized to require specialized work-stations; and yet it seems likely that many mail-sorting situations have not kept pace with the apparently always-increasing or always-changing sorting requirements imposed by the system which is vitally dependent upon the sorting task.

SUMMARY OF THE INVENTIVE CONCEPTS

In carrying out the Invention, the concepts provide apparatus and procedure by which mail and the like may be sorted rapidly and accurately, and with a high output per amount of space allotted for the sorting procedure.

More particularly, the apparatus provides a group or array of sorting modules, each containing a shelf or base and a series of vertical separator panels which in effect divide the shelf area into a plurality of bins into which individual mail work objects may be selectively placed.

Still more particularly, a frontal connection feature extends transversely of the shelf, holding all of the panels for movability as a set upwardly away from the shelf, but individually movable transversely to give in effect an automatic bin-size adjustment to individual bins.

A rearward connection of the set of separator panels aids in both of those functions.

The frontal connection is affixed to the shelf, providing that the full set of separator panels may be upwardly rotated with respect to the shelf, from a fore-and-aft panel-position which provides the multiplicity of sorting bins for accommodation of deposits of individual mail pieces in a selected bin, to an upraised position in which the panels are freed from the sorted mail batches so that the full set of sorted mail batches may be bundled as a group of code sets.

The freeing of the sorted mail-bunches from the set or frame of separator panels is thus by removal of the panels-set, rather than removal of the mail-batches from the panels-set.

An array of such shelf-and-panel modules are releasably retained on a large rack, by which the individual modules may be positioned and removed.

Other details are mentioned in the detailed description.

PRIOR ART CAPABILITY AND MOTIVATIONS, AS HELPING TO SHOW PATENTABILITY HERE

Even in hindsight consideration of the present invention to determine its inventive and novel nature, it is not only conceded but emphasized that the prior art had many details usable in this invention, but only if the prior art had had the guidance of the present concepts of the present invention, details of both capability and motivation.

That is, it is emphasized that the prior art had/or knew several particulars which individually and accumulatively show the non-obviousness of this combination invention. E.g., a. The prior art has long had sorting facilities of many shapes, natures, and sizes;

b. The prior art knew the advantages of accurate sorting;

c. The prior art has long known that avoidance of sorting errors and inconvenience is a needed characteristic of sorting facilities;

d. The ease of tooling for the present invention has surely given manufacturers ample incentive to have made modifications for commercial competitiveness in a competitive industry, if the concepts had been obvious;

e. The prior art has always had sufficient skill to make many types of sorting stations and features, more than ample skill to have achieved the present invention, but only if the concepts and their combination had been conceived;

f. Substantially all of the operational characteristics and advantages of details of the present invention, when considered separately from one another and when considered separately from the present invention's details and non-technical accomplishment of the details, are within the skill of persons of various arts, but only when considered away from the integrated and novel combination of concepts which by their cooperative combination achieves this advantageous invention;

g. The details of the present invention, when considered solely from the standpoint of construction, are exceedingly simple; and the matter of simplicity of construction has long been recognized as indicative of inventive creativity; and h. Similarly, and a long-recognized indication of inventiveness of a novel combination, is the realistic principle that a person of ordinary skill in the art, as illustrated with respect to the claimed combination as differing in the stated respects from the prior art both as to construction and concept, is presumed to be one who thinks along the line of conventional wisdom in the art and is not one who undertakes to innovate.

Accordingly, although the prior art has had capability and motivation, amply sufficient to presumably give incentive to the development of a sorting module and procedure according to the present invention, the fact remains that this invention awaited the creativity and inventive discovery of the present inventor. In spite of ample motivation and capability shown by the many illustrations herein, the prior art did not suggest this invention.

PRIOR ART AS PARTICULAR INSTANCES OF FAILURE TO PROVIDE THIS SORTING STATION AND PROCEDURE

In view of the inherent difficulties which attend the laborious task of sorting mail or other objects, it is not difficult to realize that the prior art has not projected itself to the combination purpose and achievement of the present invention, even though object-sorting is a widespread daily and practically universal task, and the table industry is quite commercial and competitive. Further, sorter users surely include an uncountable multitude of persons, at least of sufficient experience, skill, etc., that the present invention would have been desired and attempted long ago, but only if its factors and combination-nature had been obvious.

The consideration of a nature of the present inventive concepts will be helped by a summarized consideration of the prior art; however, as sorting stations are so well known and universally known and used that merely some reminders as to them as well-known prior art seem sufficient.

That is, sorting stations have been known and used, and surely made to be modifiable for many scores of years.

As to sorting capability, nothing is here asserted to be novel; and, in contrast, the concepts of the present invention provide the building upon the principal nature and function of sorting stations, rather than any modification of the sorting function, such as by separating according to marked code references.

Various types of sorting facilities are of course here conceded, but the general nature of prior art sorting facilities seems to be merely that which provides discrete and walled bins from which separated bundles are plucked. I.e., in the Prior Art, the bundles are plucked away from the bins, in contrast to a key concept here, in which the grid of bins is pulled from the bundles.

SUMMARY OF THE PRIOR ART'S LACK OF SUGGESTIONS OF THE CONCEPTS OF THE INVENTION'S COMBINATION

In spite of all such factors of the prior art, the problem here solved awaited this inventor's consideration, ideas, and creativity. More particularly as to the novelty here of the invention as considered as a whole, the resume of the prior art uses and needs helps show its contrast to the present concepts, and emphasizes the advantages, novelty, and the inventive significance of the present concepts as are here shown, particularly as to utility and convenience of use as detailed herein, as to apparatus and a procedure.

Moreover, prior art articles known to this inventor, which could possibly be adapted for this duty, fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backword look into the prior art, especially since the prior art has long had much motivation as to details of the present invention and to its provisions.

And the existence of such prior art knowledge and related articles embodying such various features is not only conceded, it is emphasized; for as to the novelty here of the combination, of the invention as considered as a whole, a contrast to the prior art helps also to remind both the great variety of the various prior art articles and needed attempts of improvement, and the advantages and the inventive significance of the present concepts. Thus, as shown herein as a contrast to all the prior art, the inventive significance of the present concepts as a combination is emphasized, and the nature of the concepts and their results can perhaps be easier seen as an invention.

Although varieties of prior art are conceded, and ample motivation is shown, and full capability in the prior art is conceded, no prior art shows or suggests details of the overall combination of the present invention, as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of an economical sorting apparatus achieving the convenience, effort-saving, cost-saving, simplicity of use, and other advantages of the present invention, which are goals only approached by the prior art, must be recognized as being a long-felt need.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility, to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

BRIEF DESCRIPTION OF THE DRAWINGS

The above description of the novel and advantageous invention is of somewhat introductory and generalized form. More particular details, concepts, and features are set forth in the following and more detailed description of an illustrative embodiment, taken in conjunction with the accompanying Drawings, which are of somewhat schematic and diagrammatic nature for showing the inventive concepts; and in the Drawings.

(For drafting convenience, this view also illustrates the position of one of the modules in an upright letter-withdrawing position in front of the attendant, this being shown in the same view which shows the attendant placing a mail work object in the appropriate receiver bin of the module, whereas ordinarily the attendant would not have pulled the module to its upright position until he had made all of his deposits of mail work objects in the modules while they are in their lowered (FIG. 3) position.)

Figure 1:
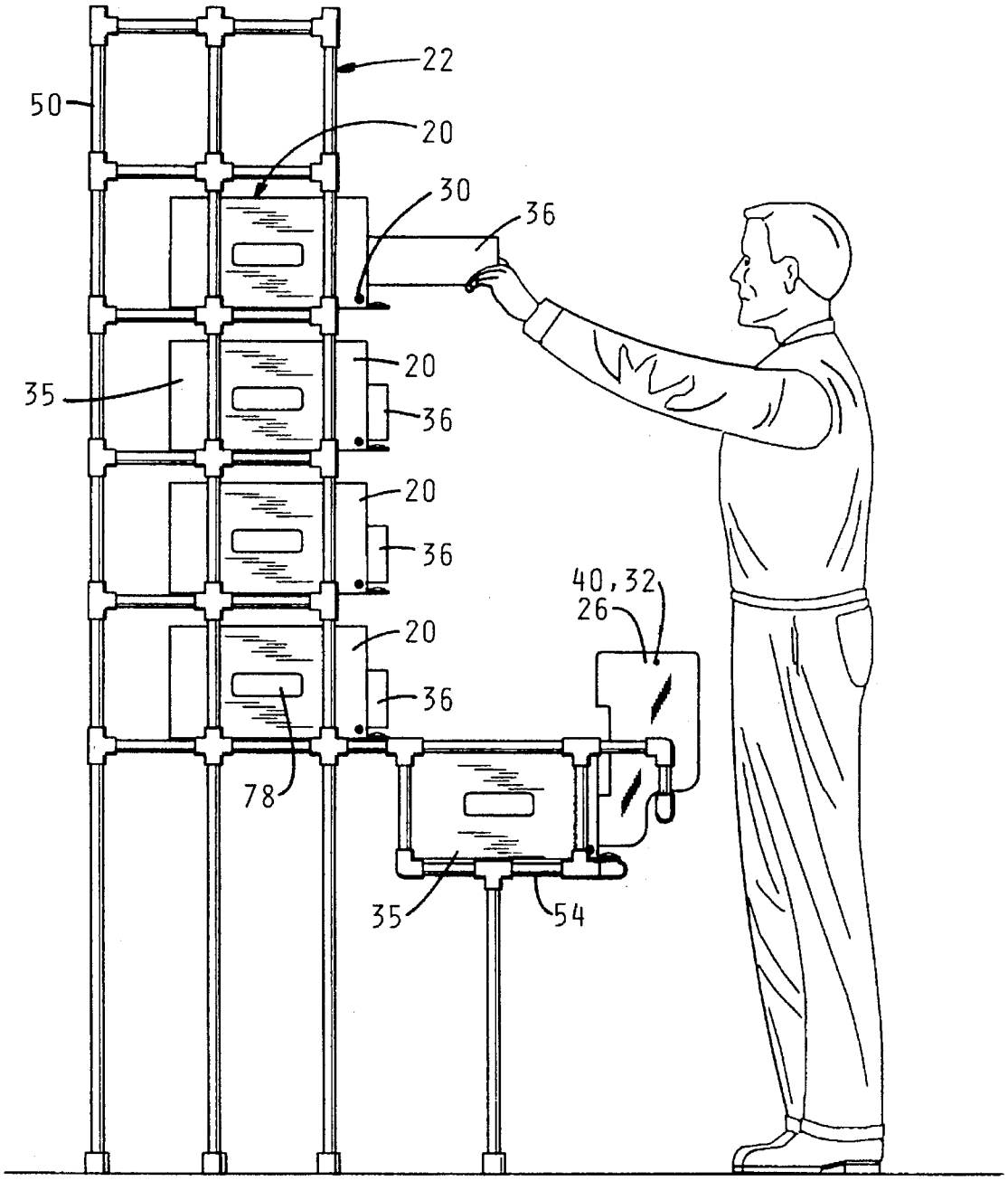
FIG. 1 is an elevation view of a sorting station installation. Modules are shown as having been placed on a frontal shelf system, and one of the modules is shown carried in a receiver tray of the systems; and an attendant is shown placing one of the mail items in the appropriate module.
Figure 2:
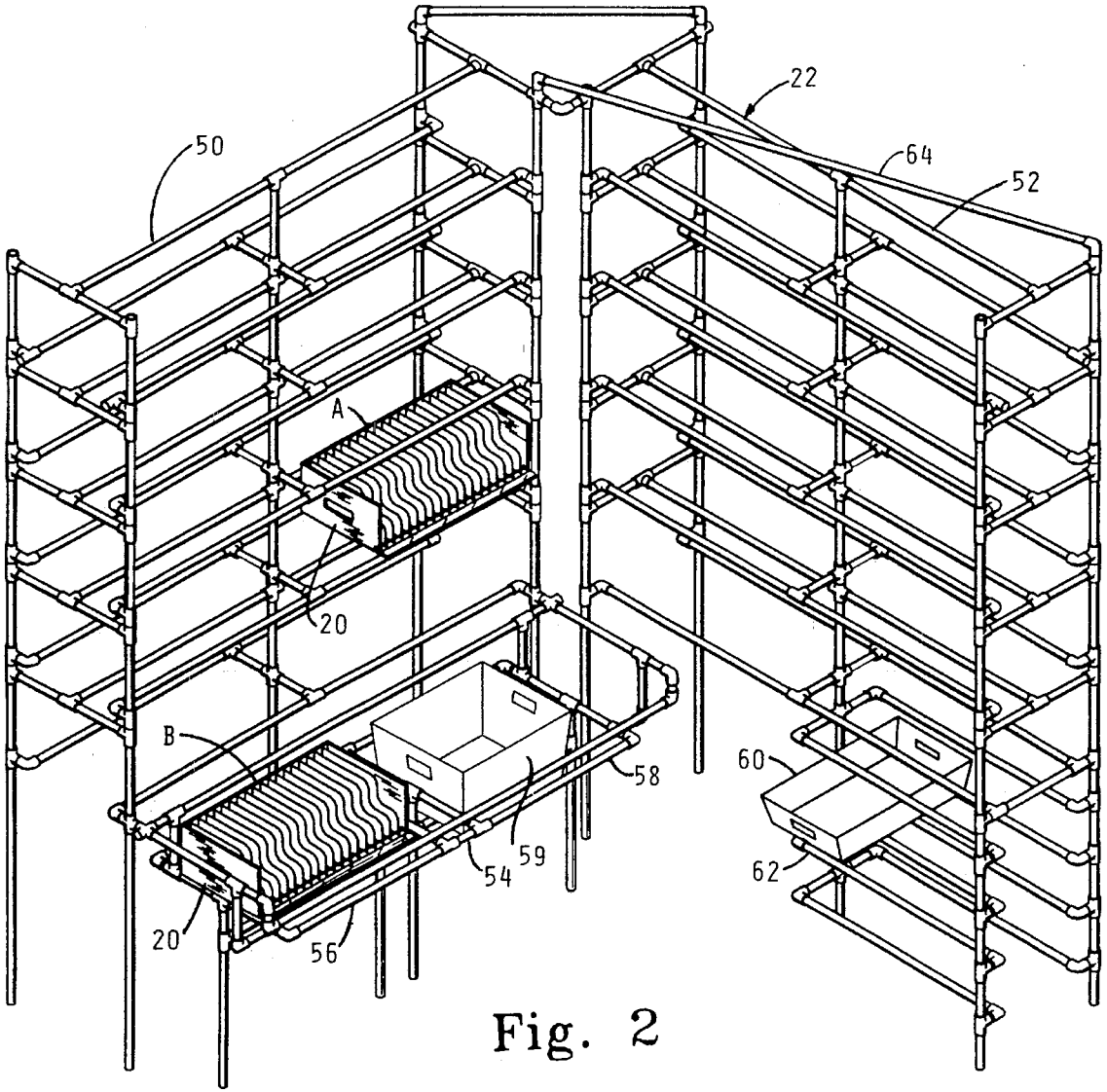
Figure 3:
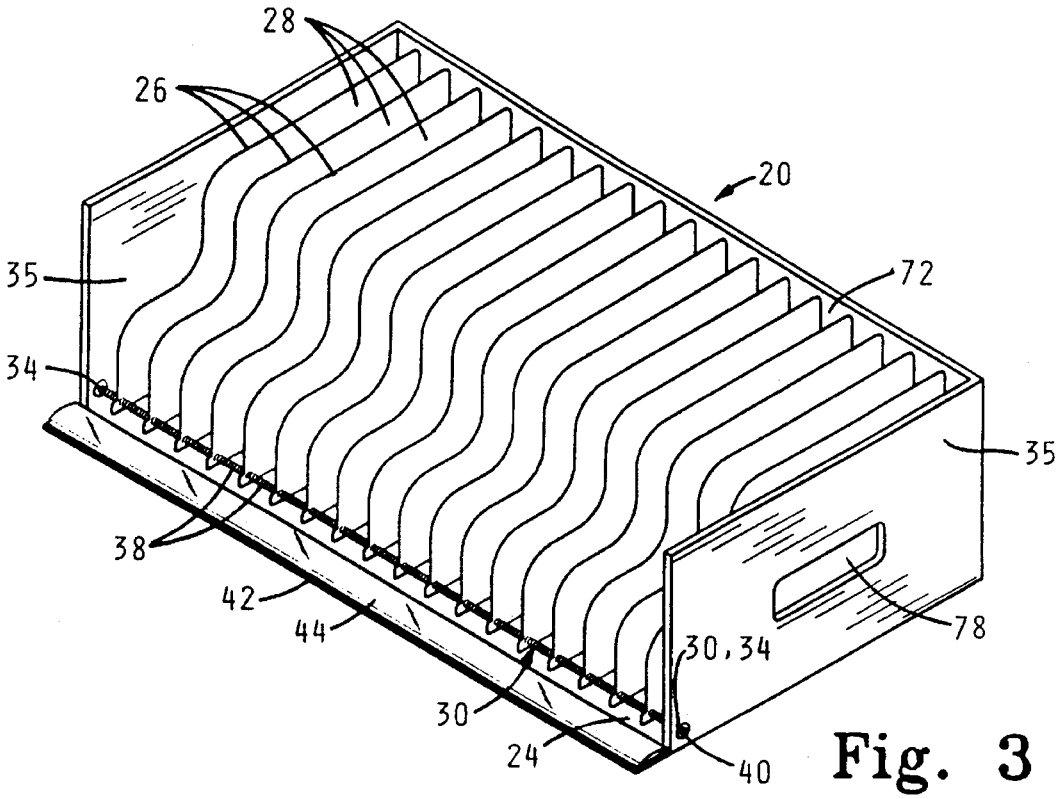
Figure 4:
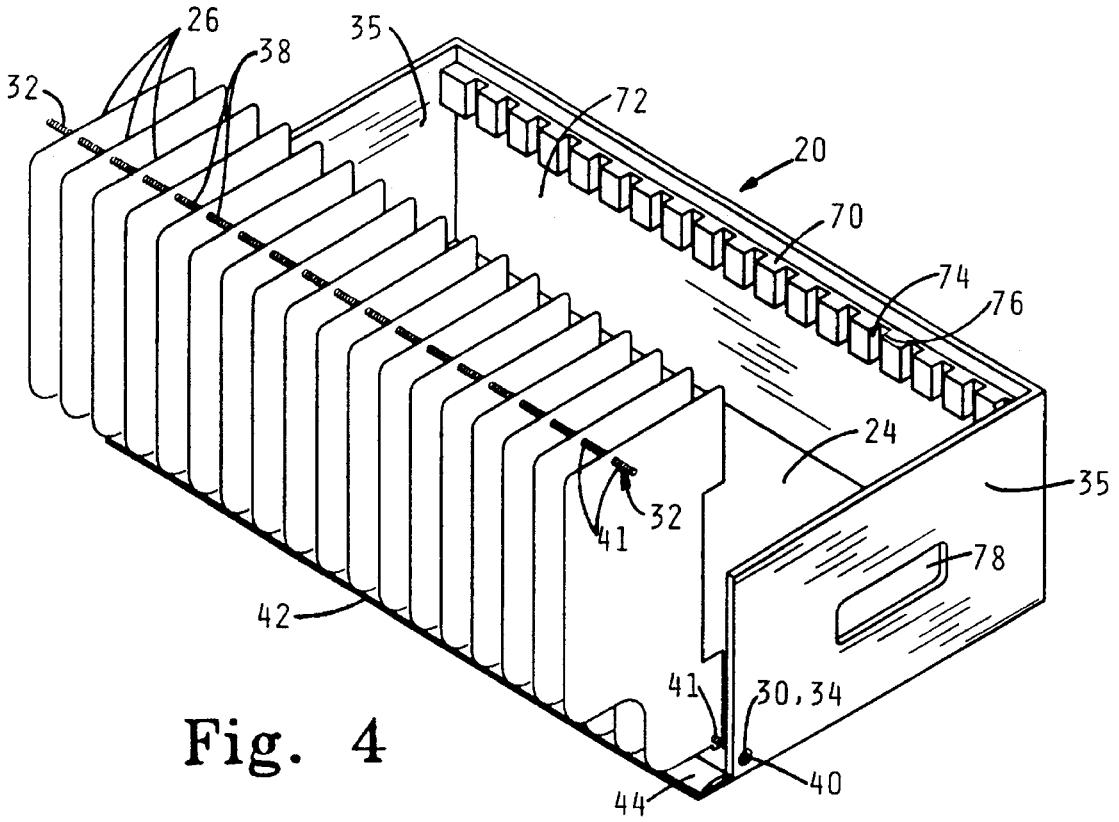
Figure 5:
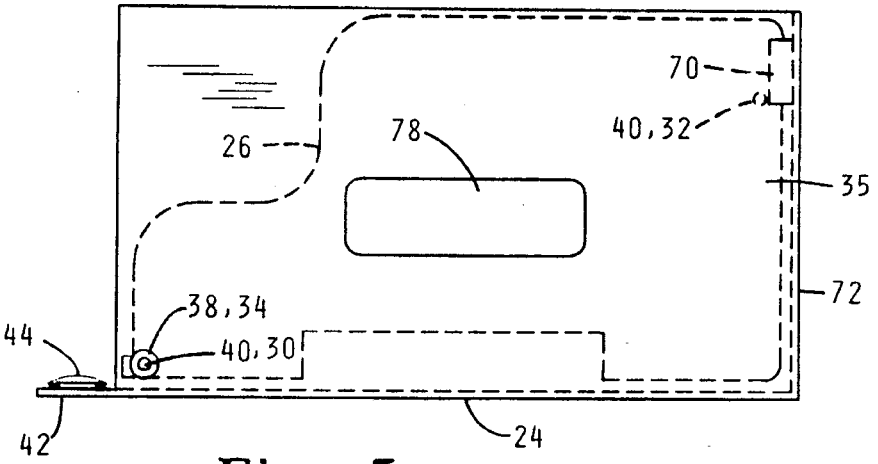
Figure 6:
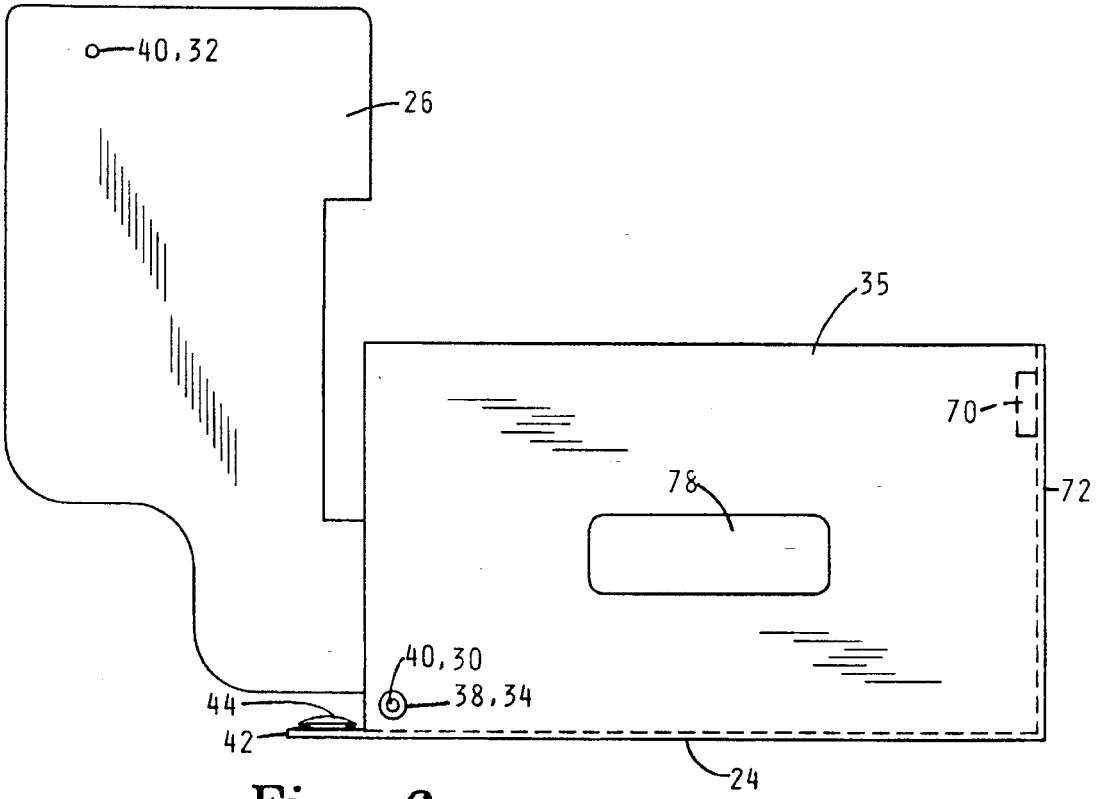
Figure 7:
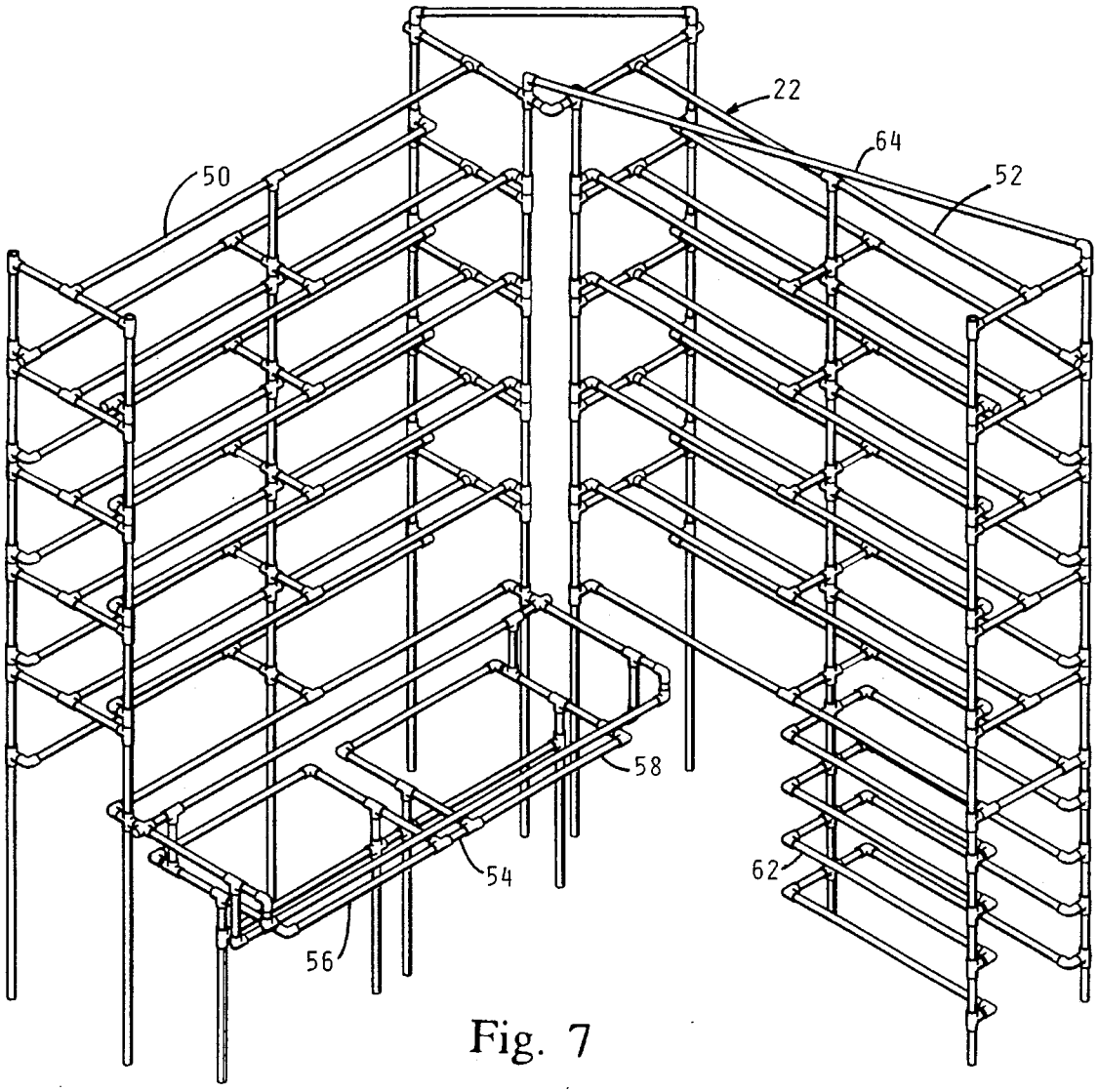
Figure 8:
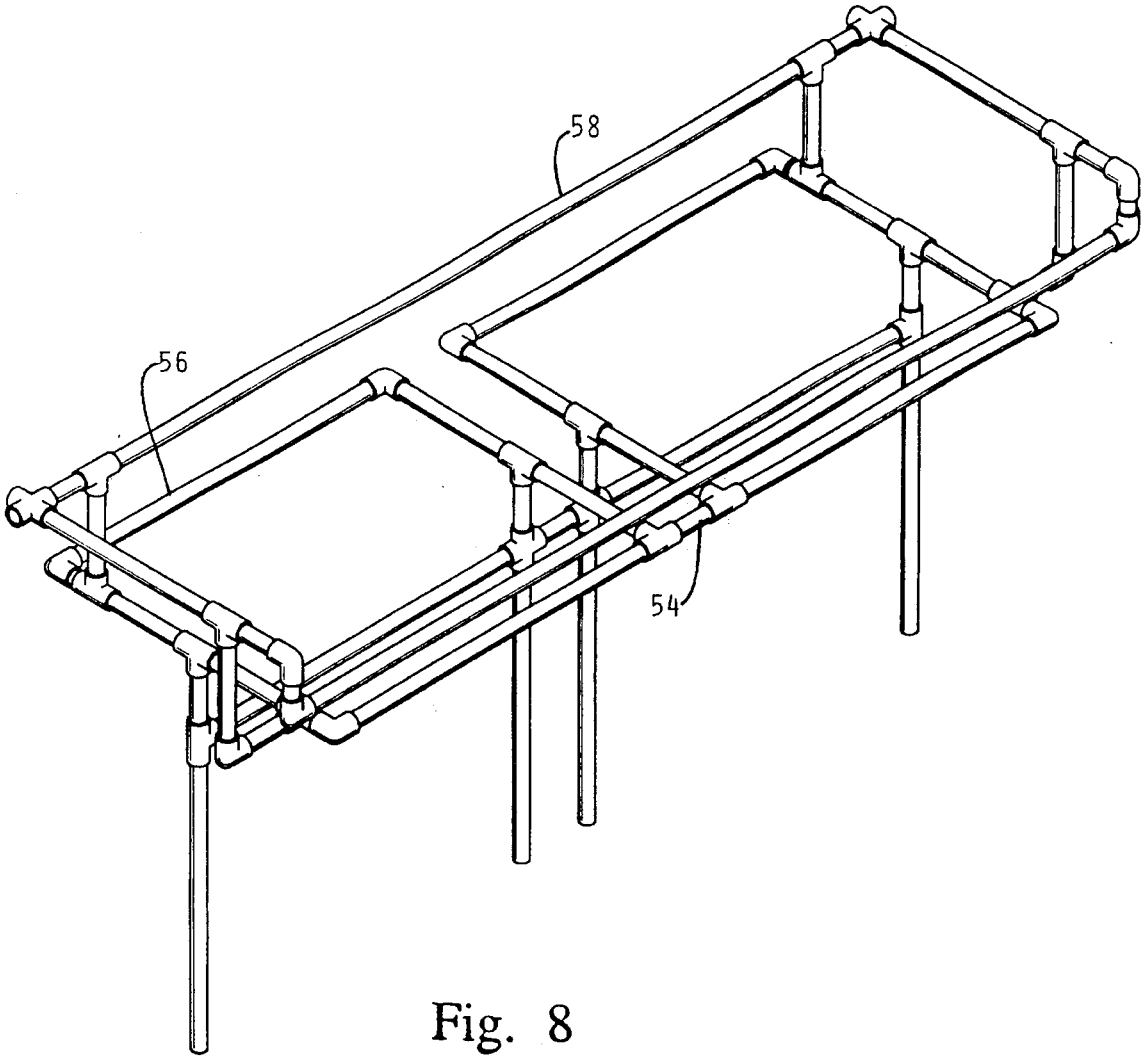
Figure 9:
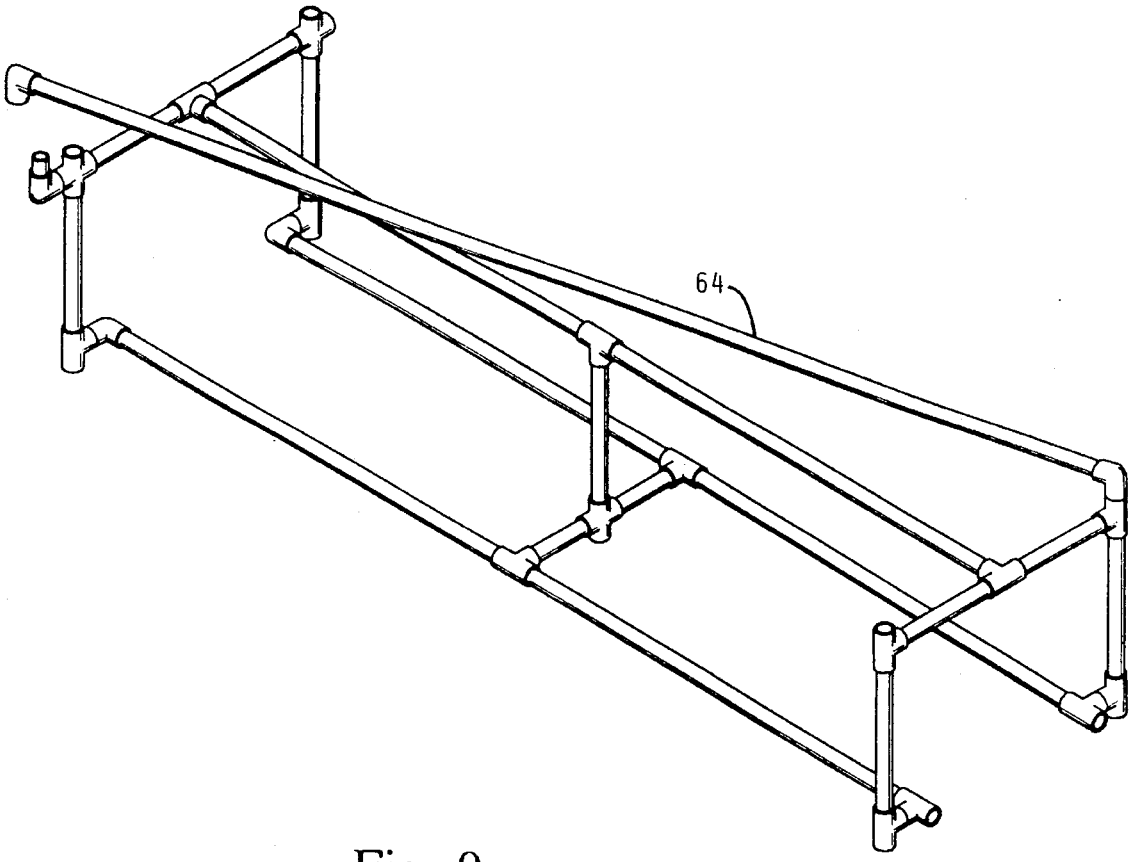
Figure 11:
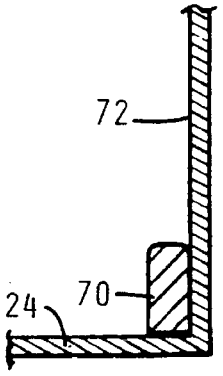
Figure 10:
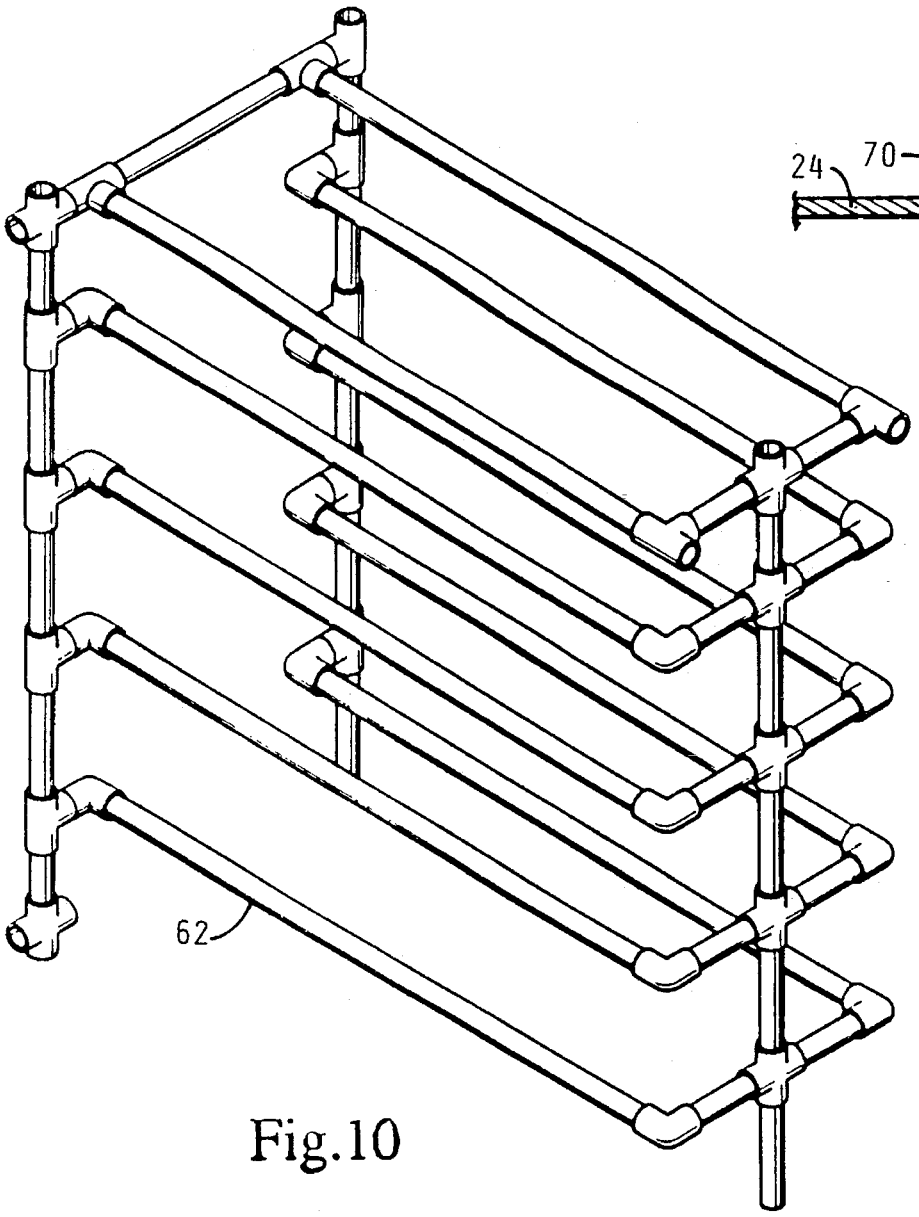

FIG. 2 is a pictorial view of a sorting station showing its shelf system with one of the modules in one of its received locations of a central shelf stack, and another one of the modules sitting in the receiver tray portion of the system;

FIGS. 3 and 4 are side elevation views of one of the modules of FIGS. 1 and 2; and FIG. 3 shows the module with its set of separator panels in its lowered or bin-forming condition; and FIG. 4 is a view similar to FIG. 3 but with the set of panel separators having been moved to its up-raised condition which would leave the sets of sorted bundles on the floor of the sorting module;

FIGS. 5 and 6 are also views of one of the sorting modules, being elevation views showing:

FIG. 5 shows the separator panels in their lowered condition of FIG. 3;

FIG. 6, like FIG. 4, shows the set of separator panels in raised condition of FIG. 4;

FIG. 7 is a pictorial view similar to FIG. 2, illustrating the array of shelves provided in a desired shelf installation;

FIG. 8 is a pictorial view of the receiver tray portion of the overall shelf system;

FIG. 9 is a pictorial view of a shelf unit, showing a stabilizer bar as one with connecting pieces between the stacked assemblies;

FIG. 10 is a pictorial view of a tray shelf which serves as a receiver of mail trays in fore-and-aft or side-to-side placement at the option of the user; and FIG. 11 is a fragmental detail view, being a vertical cross-sectional view through the back panel of the module and its rear guide strip of FIGS. 3–6 but with the guide strip carried at a much lower elevation.

(In describing the concepts of the Invention, the terms "frontal" and "forward" and, in contrast, "rearward" or "rear" (and derivations thereof) refer to adjacency to the user, as he stands in FIG. 1; i.e., in FIG. 1 he is shown as depositing a mail work object into the "frontal" or "forward" end of one of the receiver modules, and is pushing the work object "rearwardly".)

DETAILED DESCRIPTION OF ILLUSTRATIVE EMBODIMENT

As shown in the Drawings, the concepts provide both sorting modules 20 and a modular storage rack or shelving structure 22, they being cooperative, i.e., those major features 20 and 22 may be advantageously used separately or preferably in combination, the sorting modules 20 being provided especially for use with the associated supporting structure 22.

The sorting modules 20 comprise (see FIGS. 3 and 4, especially) a bottom support panel or shelf means 24 and a series of separator panels 26 which effectively provide sorting bins 28.

There is a frontal connection means 30 extending transversely of the shelf means 24, and it is movably connected to all of the series of separator panel means 26 in a loose manner, permitting them to move transversely of the shelf means 24 and rotationally with respect to the frontal connector means 30, as is noted by comparing FIGS. 3 and 4.

There is also a rearward connection means 32 which extends transversely of the shelf means 24, and it is also movably connected to the series of separator panel means 26 in a manner permitting them to move transversely of the shelf means 24.

The frontal connection means 30 is shown supportively connected to the shelf means, as shown by a nut means 34 which is connected to the side panels 35 each of which are connected to a side end of the shelf 24.

The connection of the series of separator panel means 26 to the frontal connection means 30 and the rearward connection means 32 provides that the series of separator panel means 26 may move (contrasting FIGS. 3 and 4) as a set or grid into and between a sorting position (FIG. 3), extending fore-and-aft with respect to the shelf means 24, and an upraised releasing position (FIG. 4) at least about 9020 from the sorting position.

This provides that when the series of separator panel means 26 is in its sorting (FIG. 3) position the separator panel means 26 provides a transversely extending series or set of sorting bin regions 28 extending from the shelf means 24 upwardly therefrom, for the user (as in FIG. 1) to deposit work objects 36 selectively in an appropriate sorting bin or region 28, the shelf means 24 providing a rest for the sorted work objects 36; but the series of separator panel means 26 may be then rotated upwardly and forwardly from that sorting position (FIG. 3) to their releasing (FIG. 4) position, during which movement the work objects 36 will remain resting on the shelf means 24 in a condition of sorting which has been given to the work objects 36 by their being deposited into the respective sorting regions 28 while the series of separator panel means 26 is in its sorting (FIG. 3) position, for subsequent removal of the work objects 36 while they are still in their sorted condition.

As in the embodiment shown, spring means 38 are provided between adjacent ones of the separator panel means 26; and the connection of the separator panel means 26 to each of the frontal connection means 30 and the rearward connection means 32, including the spring means 38, is such that the resiliency of the spring means 38 permits transverse movement of the separator panel means 26 accommodative to change the transverse spacing of the adjacent ones of the separator panel means 26 according to the transverse thickness of the group of work objects 36 in the various sorting regions 28 provided by the separator panel means 26.

More particularly as shown, the spring means 38 are compression springs of an open-coil nature, and the frontal and rearward connection means 30/32 comprise rods 40 extending through holes 41 in the separator panels 26. All of those holes are in sets, in aligned registry to receive the respective rod 40, and the rods 40 extend transversely of the shelf means 24, to the side panels 35; and the spring means 38 are respectively ensleeved over the respective rod 40 and are of such a length that in their unstressed condition the spring means 38 provide a spacer function separating adjacent ones of the series of separator panel means 26, but are yieldable to permit the change of transverse spacing of the panels 26.

As shown in FIGS. 3–6, there is provided adjacent the front edge 42 of the shelf means 24 a mounting strip 44 for a series of region-defining reference indicia for designating to the user the identification of the respective sorting regions 28.

Such a mounting strip 44 is desirably made as a Velcro component, with a corresponding Velcro strip on both the upper side (as shown in FIGS. 3–6) and lower side; and this doubling of mounting strip achieves the plural function of permitting a reference indicia to be held either above or below the front edge 42 of the module's bottom panels 24; and also the mounting of a Velcro component 44 on the underneath side of the front panel edge 42 provides also a frictional position-keeping task when the module is in transport. The reference indicia also would have a type of Velcro component which is holdable with a Velcro nature of the strip or strips 44.

FIGS. 1, 2, 7, 8, 9, and 10 illustrate framing of the associated shelves unit 22; and more particularly, FIGS. 2 and 7 illustrate a frontal unit 50, toward which an attendant would stand as in FIG. 1, and FIGS. 2 and 7 both show a side unit 52 of the overall framing 22. Desirably, although not shown, a left side unit of the framing would extend from the left end of the frontal set 50, similar to the placement of the right side shelving 52 which is connected to the right side of the front set of shelving 50.

FIG. 2 also illustrates the carry of one of the modules 20 in its object-receiving lowered position, this being the module also marked with the reference letter "A". This is the position of the four vertically-stacked modules in FIG. 1, i.e., in a position to receive the deposit of mail work objects.

FIGS. 1, 2, 7, and 8 show a transfer table 54 located forwardly of the vertically-extending frontal shelf unit 50, i.e., in the space (about two feet) between the torso of the sorting procedure user and the adjacent end of the modules 20 on shelf-stack 50, the open top of the transfer table 54 being at about the height of the user's hands when his arms are loosely hanging.

The transfer table 54 is handy there, and is not bothersome at that location because the user would naturally stand almost two feet away from the frontal shelf unit 50 anyway, as is schematically indicated particularly in FIG. 1, as he picks up unsorted work object items for selective deposit in modules 20 (FIG. 1).

Also shown in FIG. 2 is a module 20 which is indicated by the reference letter "B", which module 20 (B) is shown as seated on the transfer table 54 shown also in FIGS. 1, 7, and 8, in which position on the transfer table 54 the module 20 (B) would have been placed after the sorting task shown in FIG. 1 had been finished, but before the set of separator panels 26 had been swung (FIG. 1) to its upright position. (The relative positioning of the grid of separator panels 26 should be recognized to be at the option of the attendant, such as would depend upon the local work methodologies.)

The transfer table 54 (FIGS. 1, 2, 7, and 8) shows it to be of a dual nature, having a left unit and a right unit (as the attendant faces the frontal shelf stack 50), those two units shown as provided by a retangular framing bed 56 and a right frame bed 58.

The leftward framing bed 56 is shown as a size convenient to hold a module 20 (shown here as module "B"), and the rightward framing bed 58 is shown of a size convenient to carry a similarly-sized accessory carton or box 59 loaded with work object items to be sorted; but the use of transfer table 54 and its portions 56 and 58 is according to the methodology at that work site.

In the right side shelving unit 52 there is shown a "mail" tote", this being an accessary box 60 for miscellaneous use depending upon the local office methodology, such as to receive a bundled stack of sorted mail which has been retrieved from the module 20 (B).

FIG. 2 also shows, as an optional item, a lowermost (62) series of shelves of a lesser depth than would be needed for a module 20, to hold more shallow work objects such as standard letter sizes, tote boxes 60, etc.

The views of FIGS. 2 and 7 also show a sway brace 64 which connects at one end to a frontal shelf unit 50 and at the right shelf stack 52, getting the combination the bracing effect of a triangular support.

Preferably as shown, all of the shelf units 22 are formed of a polyvinyl chloride (PVC) tubing to which standard tee or other joining pieces are provided, all to the goal of size and shape of the various shelf sets to best meet the needs and methodologies of the particular office; and details such as legs for the various shelf units 22,50,52,54, 56,58, and 62 are of course provided to fit the particular office.

Added details of the overall combination include (FIGS. 4 and 11) a rear guide strip 70 which is mounted on the module 20's rear panel 72 and thus is operatively affixed to the shelf means 24.

The guide means 70 comprises a transversely extending series of pairs of abutments 74/76, the abutments of each pair of abutments 74/76 being spaced from one another and each pair of abutments providing retainer means spaced apart, adjacent the plane of a respective separator panel means 26.

The spacing of each pair of abutments 74/76 is accommodative of the transverse movement of the respective separator panel means 26 when the series of separator panel means 26 is in its sorting (FIGS. 3, 5) position, all the abutment sets 74/76 of the retainer means 74/76 being shown as provided from a single strip of material provided with a transversely extending series of recesses, the walls 74/76 of which provide the retainer means abutments 74/76.

Especially in the usual case of mail objects 36 being of different heights, it may be desired (FIG. 11) that the retainer means abutments 74/76 be provided to be in a location adjacent the shelf means 24 and generally at the elevation of the frontal connection means 30.

Other details of the modules 20 and shelving 22, such as dimensions, number of bins 28, material of the modules 20, type of modules' handle 78, etc., will depend upon needs of a particular office, all within the concepts set forth.

SUMMARY OF COMPONENTS AND OPERATIONAL DETAILS, AND THEIR ADVANTAGES

The present invention as detailed herein has advantages in both concept and in component parts and features; for in contrast to other articles known to the inventor as to the prior art mentioned, the invention provides advantageous features which should be considered, both as to their individual benefit, and to whatever may be considered to be also their synergistic benefit toward the invention as a whole. Such features include:

(a) Easy to use, with advantages of accessability and vision;

(b) Certain as to sorting effects;

(c) Use is easy to learn;

(d) Economical of formation; and (e) Provides convenience of sorting without inherent disadvantages of other sorting facilities.

The various features provide a sorting station installation particularly beneficial to that of a U.S. Post Office facility, although the concepts are not limited to that type of use. Such features of that particular type of use include both ergonomic and design factors including:

(f) Modules system facilitates local fabrication as to both local purchases and assembly, allowing individual offices and routes to tailor the system to local circumstances and personnel, floor plans, and other local factors and special needs;

(g) Such assemblies are compatible to both rural and city carrier methodologies; e.g., rural cases may differ from city carrier cases in that the reference indicia may be located above the modules (shelves) for the former and below the shelf (module) for the latter;

(h) Compatible with traditional or vertical flat techniques and adaptable to single or multiple bundles in a variety of configurations to all route types with their special natures or needs; e.g., shelf heights are easily adjusted to accommodate traditional six row carrier cases and/or four and five rows of vertical flat casing techniques ("flats" being magazines and the like);

(i) Ergonomic design allows customizing to individual carrier height; e.g., case legs are cut to provide most comfortable range for sorting mail in conformity to regular carrier's height;

(j) Minimizes handling of the mail in both office and street functions, by incorporating inventory containers as integral work surfaces; thus pull down and strapping out times are minimized; i.e., U.S.P.S. existing inventory containers (plastic and cardboard letter trays, and flat totes) fit into transfer table, with no dumping of mail or rehandling required;

(k) Various features act synergisticly by fulfilling goals of projected savings; particularly there are time savings in office prep, pull-down/strapping out and street functions (especially for mounted routes);

(l) Easily custom fitted to individual carriers (case "follows" carrier); e.g., if a carrier "bids" from one route to another in the same office the customized module goes with him/her, and label changes are all that is required;

(m) Centralized rubber band or other accessory containers; e.g., a plastic rubber band container is ergonomically located in the front center of the transfer table and others are optional, for writing utensils, etc.;

(n) Can be set up to accommodate natural arc of physical movements; i.e., module shelving may be set up in semicircular fashion within the framework, to accommodate vision and arm movements natural to the sorting function;

(o) Minimizes mail handling by incorporating standard containers as work surface; e.g., certain mail trays may be modified to become sorting modules, with no new tooling needed;

(p) Minimizes mail handling by organizing flat and letter standby containers; i.e., framework rack prevents mixing of "flat" trays and totes with letter trays, saving carrier's office time;

(q) Allows use of modern efficient lighting; i.e., tubular frame allows more ambient light to reach the carrier, and the white PVC material is reflective; and the tubular PVC fittings are adaptable to low wattage screw type fluorescent fixtures;

(r) Maximizes space utilization through integral "hold mail" feature; e.g., part of the shelving may be used as an optional rack for offices where special items such as "vacation hold" mail is carrier responsibility, integral to framework, utilizing space efficiently;

(s) Allows convenient local mail container storage spaces; e.g., the framework accommodates empty containers (totes and trays, etc.);

(t) Standardizes locations and allows spaces for various carrier forms to be used as supplements; i.e., it provides top row space of sufficient volume to accommodate multitude of carrier forms;

(u) Prevents mixing of letters/flats; i.e., the accommodation is plentiful, separate, and of various sizes;

(v) Allows handling of dimensionally large flats without bending; e.g., larger vertical space between shelves accommodate 8"×10" photo mailers without bending, whereas current 5 and 6 row cases lack this feature;

(w) Has "case stretcher" feature; i.e., the transverse movability of the panels provide automatic enlargement of whichever sorting bin needs it;

(x) Virtually eliminates overlooked "sleeper" items; i.e., since module is withdrawn from the shelving for mounted portions of routes, with the grid of panels still in lowered position, or pulled with the panel separators rotated upwardly to reveal all mail, sleepers (left over mail) are virtually eliminated;

(y) Facilitates more accurate mail measurements and other quantitative data; i.e., stacked, intermixed (flats with letters) mail containers of the prior art are difficult to accurately "measure" vs. the invention's organized open lattice-type frame which facilitates "measurement";

(z) Optional hamper storage space; i.e., the "case" or modular framework provides port for carrier mail "hampers", freeing up valuable floor space and hazard of haphazard hamper placement;

(aa) Optional hamper modules allow more parcels or other special size items; i.e., the PVC framework attaches to carrier mail hampers to facilitate additional mail capacity, thus eliminating wasteful multiple trips for vehicular loading;

(bb) Optional retainer rack modules keep tray module in an organized and secure manner; i.e., the receiving racks of a route vehicle receive and secure the sorting modules for mounted portions of routes;

(cc) Allows modifications and/or add-ons at low cost; i.e., the PVC tubing is inherently inexpensive and easily worked with numerous fittings to accommodate special features (e.g., casters, integral object displays, drink holders, etc.); and (dd) Provides changeable bin-labelling and custom-made details; e.g., the arrangement is compatable and/or adaptable to "square-tube" and other labelling products by which the bins may be labelled individually for each sorting module.

CONCLUSION AS TO INVENTIVE COMBINATION

It is thus seen that a sorting module and integrated assembly constructed and used according to the combination of inventive concepts and details herein set forth, provides novel concepts of a desirable and usefully advantageous article and procedure, yielding advantages which are and provide special and particular advantages when used as herein set forth.

In summary as to the nature of the overall module's advantageous concepts, their novelty and inventive nature is shown by novel features of concept and construction shown here in advantageous combination and by the novel concepts hereof not only being different from all the prior art known, even though other sorting stations have been known and used for scores of years, but because the achievement is not what is or has been suggested to those of ordinary skill in the art, especially realistically considering this as a novel combination comprising components which individually are similar in nature to what is well known to most all persons, surely including most of the many makers and users of sorting apparatus for a great number of years, throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long worldwide use of various types of sorting facilities.

The differences of concept and construction as specified herein yield advantages over the prior art; and the lack of this invention by the prior art, as a prior art combination, has been in spite of this invention's apparent simplicity of the construction once the concepts have been conceived, in spite of the advantages it would have given, and in spite of the availability of all the materials, to all persons of the entire world, and the invention's non-technical and openly-visible nature.

Quite certainly this particular combination of prior art details as here presented in this overall combination has not been suggested by the prior art, this achievement in its particular details and utility being a substantial and advantageous departure from prior art, even though the prior art has had similar components for numbers of years. And particularly is the overall difference from the prior art significant when the non-obviousness is viewed by a consideration of the subject matter of this overall device as a whole, as a combination integrally incorporating features different in their combination from the prior art, in contrast to merely separate details themselves, and further in view of the prior art not achieving particular advantages here achieved by this combination.

Accordingly, it will thus be seen from the foregoing description of the invention according to these illustrative embodiments, considered with the accompanying drawings, that the present invention provides new and useful concepts of a novel and advantageous article and procedure, possessing and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

I claim:

1. A sorting module for use with an associated supporting structure, the sorting module comprising, in combination:

a shelf means, a series of separator panel means, a frontal connection means extending transversely of the shelf means, and movably connected to the series of separator panel means in a manner permitting them to move transversely of the shelf means and rotationally with respect to the frontal connector means, a rearward connection means extending transversely of the shelf means, and movably connected to the series of separator panel means in a manner permitting them to move transversely of the shelf means, the frontal connection means being supportively connected to the shelf means, the connection of the series of separator panel means to the frontal connection means and the rearward connection means providing that the series of separator panel means may move into and between a sorting position extending fore-and-aft with respect to the shelf means and an upraised releasing position at least about 90° from the sorting position, the arrangement being such that when the series of separator panel means is in its sorting position the separator panel means provides a transversely extending series of sorting regions extending from the shelf means upwardly therefrom, for the user to deposit work objects selectively in an appropriate sorting region, the shelf means providing a rest for the work objects, but the series of separator panel means may be then rotated from that sorting position to their releasing position, during which movement the work objects will remain resting on the shelf means, in a condition of sorting which has been given to the work objects by their being deposited into the respective sorting regions while the series of separator panel means is in its said sorting position, for subsequent removal of the work objects while they are still in their sorted condition.

2. A sorting module according to claim 1, in a combination in which spring means are provided between adjacent ones of the separator panel means, and the connection of the separator panel means to each of the frontal connection means and the rearward connection means including the spring means is such that the resiliency of the spring means permits transverse movement of the separator panel means accommodative to change the transverse spacing of the adjacent ones of the separator panel means according to the transverse thickness of the work objects in the various sorting regions provided by the separator panel means.

3. A sorting module according to claim 2, in a combination in which the spring means are compression springs of an open-coil nature, and the frontal and rearward connection means comprise rods extending transversely of the shelf means; and the spring means are respectively ensleeved over the respective rod, and are of such a length that in their unstressed condition the spring means provide a spacer function separating adjacent ones of the series of separator panel means, but yieldable to permit the said change of transverse spacing thereof.

4. A sorting module according to claim 1, in combination in which there are provided adjacent the front edge of the shelf means a series of region-defining reference indicia for designating to the user the identification of the respective sorting regions.

5. A sorting module according to claim 2, in a combination in which guide means are provided, operatively affixed to the shelf means, the guide means comprising a transversely extending series of pairs of abutments, the abutments of each pair of abutments being spaced from one another and each pair of abutments providing retainer means spaced apart adjacent the plane of a respective separator panel means, the spacing being accommodative of the transverse movement of the respective separator panel means when the series of separator panel means is in its sorting position.

6. A sorting module according to claim 3, in a combination in which guide means are provided, operatively affixed to the shelf means, the guide means comprising a transversely extending series of pairs of abutments, the abutments of each pair of abutments being spaced from one another and each pair of abutments providing retainer means spaced apart adjacent the plane of a respective separator panel means, the spacing being accommodative of the transverse movement of the respective separator panel means when the series of separator panel means is in its sorting position.

7. A sorting module according to claim 5, in a combination in which the abutments which provide the retainer means are provided from a single strip of material provided with a transversely extending series of recesses the walls of which provide the said retainer means abutments.

8. A sorting module according to claim 6, in a combination in which the abutments which provide the retainer means are provided from a single strip of material provided with a transversely extending series of recesses the walls of which provide the said retainer means abutments.

9. A sorting module according to claim 5, in a combination in which the retainer means abutments are provided to be in a location adjacent the shelf means and generally at the elevation of the frontal connection means.

10. A sorting module according to claim 6, in a combination in which the retainer means abutments are provided to be in a location adjacent the shelf means and generally at the elevation of the frontal connection means.

11. A sorting module according to claim 7, in a combination in which the retainer means abutments are provided to be in a location adjacent the shelf means and generally at the elevation of the frontal connection means.

12. A sorting module according to claim 8, in a combination in which the retainer means abutments are provided to be in a location adjacent the shelf means and generally at the elevation of the frontal connection means.

* * * * *

UNITED STATES PATENT AND TRADEMARK OFFICE

CERTIFICATE OF CORRECTION

PATENT NO. : 5,590,794

DATED : Jan. 7, 1997

INVENTOR(S) : Gordon E. Zachary

It is certified that error appears in the above-identified patent and that said Letters Patent is hereby corrected as shown below:

Col. 6, line 28 Change "9020" to: -- $90^{\circ}$ --.

Col. 11, line 63 Change "I claim:" to: -- Claims --.

Signed and Sealed this

Fifteenth Day of April, 1997

Bruce Lehman

*Attest:*

BRUCE LEHMAN

*Attesting Officer*

*Commissioner of Patents and Trademarks*